United States Patent [19]

Malihi et al.

[11] Patent Number: 4,921,629

[45] Date of Patent: May 1, 1990

[54] HEAVY DUTY HARD SURFACE LIQUID DETERGENT

[75] Inventors: Farrokh B. Malihi, Kendall Park; Nicholas J. Sparacio, Edison, both of N.J.

[73] Assignee: Colgate-Palmolive Company, Piscataway, N.J.

[21] Appl. No.: 181,022

[22] Filed: Apr. 13, 1988

[51] Int. Cl.[5] ..... C11D 3/43

[52] U.S. Cl. ..... 252/170; 252/135; 252/156; 252/158; 252/162; 252/171; 252/174.14; 252/174.21; 252/525; 252/544; 252/DIG. 14

[58] Field of Search ..... 252/DIG. 14, 162, 170, 252/174.21, 135, 174.14, 171, 156, 158, 525, 544

[56] References Cited

U.S. PATENT DOCUMENTS

| | | | |
|---|---|---|---|
| 2,471,645 | 7/1949 | Morris et al. | 252/137 |
| 3,806,460 | 11/1974 | Mukai et al. | 252/111 |
| 3,808,051 | 2/1974 | Schoenholz et al. | 134/2 |
| 3,819,529 | 1/1974 | Murphy | 252/156 |
| 3,829,387 | 6/1974 | Wise et al. | 252/156 |
| 3,876,563 | 9/1975 | Collins | 252/545 |
| 3,881,948 | 11/1975 | Schoenholz et al. | 134/2 |
| 3,887,497 | 7/1975 | Ulvild | 252/526 |
| 4,056,113 | 3/1977 | Johnson et al. | 134/40 |
| 4,085,059 | 1/1978 | Smith et al. | 252/118 |
| 4,105,574 | 2/1978 | Culmone et al. | 252/154 |
| 4,116,848 | 3/1978 | Schoenholz et al. | 252/90 |
| 4,133,779 | 12/1979 | Hellyer et al. | 252/547 |
| 4,193,886 | 3/1980 | Schoenholz et al. | 252/90 |
| 4,199,482 | 7/1980 | Renaud et al. | 252/559 |
| 4,236,935 | 9/1980 | Schoenholz et al. | 134/2 |
| 4,243,559 | 2/1981 | Imamura et al. | 252/548 |
| 4,268,406 | 11/1981 | O'Brien | 252/105 |
| 4,302,348 | 2/1981 | Requejo | 252/135 |
| 4,407,741 | 1/1983 | Maggi | 252/542 |
| 4,414,128 | 3/1983 | Goffinet | 252/111 |
| 4,438,009 | 4/1984 | Brusky et al. | 252/90 |
| 4,457,322 | 12/1984 | Rubin et al. | 134/2 |
| 4,465,619 | 6/1984 | Boskamp | 252/540 |
| 4,477,288 | 7/1984 | Kazmierczak et al. | 134/19 |
| 4,528,039 | 9/1985 | Rubin et al. | 134/2 |
| 4,530,780 | 1/1985 | van de Pas et al. | 252/528 |
| 4,532,067 | 3/1985 | Padron et al. | 252/174.17 |
| 4,537,638 | 7/1985 | Petersen et al. | 134/2 |
| 4,564,463 | 6/1986 | Secemski et al. | 252/174.17 |

FOREIGN PATENT DOCUMENTS 1178160 4/1984 Canada .
1275740 12/1972 United Kingdom .

OTHER PUBLICATIONS

Day et al., "Strength of Bonding of Food Soils to Dishes", *Journal of the American Oil Chemists Society* 552, 461–464 (1975).

Menger, "Interfacial Physical Organic Chemistry, Imidazole-Catalyzed Ester Hydrolysis at a Water-Heptane Boundary", *Journal of the American Chemical Society* 92:20, 5965–5971 (1970).

*Primary Examiner*—Paul R. Michl
*Assistant Examiner*—Hoa V. Le
*Attorney, Agent, or Firm*—Richard J. Ancel; Marta E. Delsignore; Robert C. Sullivan

[57] ABSTRACT

A single phase, highly aklaline, liquid detergent composition particularly effective in removing airborne kitchen grease from hard surfaces is provided which comprises, by weight:

a. from about 1 to 5% of a surfactant selected from the group consisting of nonionic surfactants (including alcohol ethoxylates and amine oxides, wherein the alcohol ethoxylate is selected from the group consisting of linear primary alcohol ethoxylates, random secondary alcohol ethoxylates) and amphoteric surfactants (comprising water-soluble betaines) and mixtures thereof;

b. about 2% of a builder selected from the group consisting of tetrapotassium pyrophosphate (TKPP), sodium tripolyphosphate (STPP), sodium metasilicate, sodium carbonate, sodium bicarbonate, and c. about 2% of an alkanolamine selected from the group consisting of monoethanolamine, diethanolamine, and triethanolamine;

d. from about 2 to 8% of at least one water miscible, preferably polar organic solvent selected from the group consisting of water soluble glycol ethers (including diethylene glycol monobutyl ether, ethylene glycol monobutyl ether, ethylene glycol methyl ether, and propylene glycol methyl ether) and alkyl acetates; and e. water.

8 Claims, No Drawings

HEAVY DUTY HARD SURFACE LIQUID DETERGENT

BACKGROUND OF THE INVENTION

This invention relates to compositions, preferably in the form of clear, single phase liquids, that are particularly useful in removing aerosolized, polymerized, or airborne hardened grease from kitchen surfaces.

Airborne grease, polymerized grease, or aerosolized grease are names applied to the type of greasy soil which results from the deposition of oil particles on kitchen surfaces during various cooking processes involving edible fats and oils, i.e., deep frying, grill frying, etc. During such frying of foods, particles of fats and oils spatter and splash and eventually deposit on various kitchen surfaces such as countertops, floors, walls and appliance surfaces. This type of greasy soil or "aerosolized grease," upon contact with the substrate undergoes a number of chemical reactions and forms a semi-solid gel structure, which strongly adheres to the substrate. The result is a difficult to remove greasy soil that contains a significant amount of insoluble and polar fractions.

The following are the major changes that have been found to occur in the physical and chemical properties of cooking oils as the oils are treated under deep frying conditions and aged on kitchen surfaces:

Initially the oil is a liquid (at room temperature), and it is composed of a mixture of low molecular weight unsaturated triglycerides with no significant polar compounds (free fatty acids). This oil has a viscosity of about 60 cps and adheres weakly to the substrate.

As the oil is exposed to high temperature, air, and moisture during deep frying (and following aging at room temperature), various chemical reactions, including polymerization, hydrolysis, and oxidation take place. The rate and extent of these reactions depend on the nature of the oil, the temperature and the operating conditions. Key physical and chemical changes in oil properties which take place upon this treatment can be summarized as follows:

1. Substantial reduction in the level of unsaturated fractions and formation of dimers and trimers, as the oil undergoes thermal and oxidative polymerization. This results in a major increase in oil viscosity as the oil transforms from a liquid to a gel (or solid, in the case of linseed oil).

2. Significant increase in the free fatty acid content of the oil. This results in increased tackiness and greater adhesion to the substrate, particularly glass and metal surfaces via polar bonds.

Commercial multipurpose cleaners containing mixtures of surfactant and salt are not effective in removing such greasy soil. It has now been discovered, though, that it is possible to formulate a nonabrasive, liquid cleaning composition which effectively removes such greasy soil. The proposed composition utilizes high alkalinity to neutralize the polar groups of the soil to aid detachment, a solvent to penetrate and to swell the soil, and a surfactant to wet and disperse the soil.

BRIEF DESCRIPTION OF THE INVENTION

Generally, the compositions of this invention consist of the following essential ingredients:

1. A water miscible, preferably polar, organic solvent which provides penetration into and swelling of the soil.

2. A short chain, nonionic surfactant of low molecular weight with optimum hydrophilic/hydrophobic balance to provide wetting and to enhance detachment from the substrate. Amphoteric surfactants and combinations of nonionic and amphoteric surfactants may also be used.

3. A builder/buffer agent to provide a high pH alkaline environment for saponification and hydrolysis of the grease so that the polar groups of the residue are neutralized.

4. An alkanolamine to serve as a protein denaturant, which extends the efficacy on other types of food soils including egg and meat residue.

5. Water.

The compositions of the present invention are formulated as clear, single phase liquids, but they may be provided in other forms such as gels and aerosols, and they may be dispensed from pump sprayers, trigger spray or foamer bottles, aerosol cans, and the like.

Specifically, formulations according to the present invention are highly alkaline (having a pH ranging from 9–13) and comprise:

a. from about 1 to 5% of a surfactant selected from the group consisting of nonionic surfactants (low molecular weight, short chain), amphoteric surfactants and mixtures thereof;

b. about 2 to 6% of a builder salt selected from the group consisting of polyphosphates, pyrophosphates, silicates, metasilicates, and carbonates;

c. from about 1 to 5% of an alkanolamine selected from the group consisting of monoethanolamine, diethanolamine and triethanolamine;

d. water; and e. about 2 to 8% of at least one water miscible, preferably polar organic solvent selected from the group consisting of water soluble glycol ethers (including diethylene glycol monobutyl ether, ethylene glycol-monobutyl ether, ethylene glycol methyl ether, and propylene glycol methyl ether) and $C_6$–$C_{13}$ alkyl acetates.

It has now been found that aerosolized grease residues can be effectively removed from hard surfaces by: contacting such soiled surfaces with an effective amount of the above-identified liquid detergent compositions; allowing an effective amount of time for the composition to soak through the soil; and then wiping the affected soiled surfaces to remove the detergent composition and the solubilized greasy residue.

These compositions provide superior efficacy on hard-to-remove aerosolized grease, when compared to commercially available, spray products. Moreover, they are mild to human skin; can be easily packaged in a trigger spray or trigger foamer bottle; and have a mild odor, which can easily be masked by perfume.

KEY TO INGREDIENTS HEREIN

Alfonic 610-50 is the trade name for primary alcohol ethoxylate ($C_6$–$C_{10}$ with 50% EO) made by Vista Chemical.

Barlox-14 is the trade name for alkyl ($C_{10}$–$C_{14}$) dimethyl amine oxide made by Lonza.

Betaine BL-158 is the trade name for alkyl dimethyl betaine ($C_{12}$–$C_{14}$) made by Goldschmidt Chemical Corp.

Butoxydiglycol (CTFA name)—diethylene glycol monobutyl ether—Butyl Carbitol—Union Carbide.

Butoxyethanol (CTFA name)—ethylene glycol monobutyl ether—Butyl Cellosolve—Union Carbide.

Cocamide DEA (CTFA name)—Coconut diethanolamide—Monoamid 150 ADD—Mona.

Cocoamidopropyl Betaine—Surco Coco Betaine—Onyx.

DEA—diethanolamine.

EDTA—Ethylene diamine tetra acetic acid.

Exxate 600 is trade name for hexyl acetate made by Exxon Chemicals.

Lauric/Myristic Diethanolamide—The fatty acid of the amide is a mixture of lauric and myristic acids, usually in a proportion of 1:3 to 3:1 and preferably about 1:1. Thus, such material is really a mixture of two different diethanolamides but is generally named for convenience as lauric/myristic diethanolamide or LMDEA.

MEA—monoethanolamine.

Neodol 23-6.5 is the trade name for primary alcohol ethoxylate ($C_{12}$–$C_{13}$, 6.5 EO) made by Shell.

Pareth 25-9 (CTFA name)—polyethylene glycol ether mixture of synthetic $C_{12-15}$ fatty alcohols with any average of moles of ethylene oxide—Neodol 25-9(Shell).

Tergitol 15-S-9 is the brand name for secondary alcohol ethoxylate ($C_{11}$–$C_{15}$,9EO) made by Union Carbide Corp.

TEA—triethanolamine.

TKPP—tetrapotassium pyrophosphate.

DETAILED DESCRIPTION OF THE INVENTION

The grease removing compositions of this invention are essentially comprised of the following components: surfactant, builder, alkanolamine, water, and solvent. In addition to the above ingredients, the compositions of this invention may contain other substances generally present in detergent compositions. For example, the composition may be thickened if desired by the addition of known viscosity increasing agents. Foam stabilising agents may also be incorporated, and other ingredients which may normally be present include preservatives, humectants, foam boosters, anti-foaming agents, dispersants, pH modifiers, colorants, and perfumes.

According to a first embodiment of the invention, the surfactant, which is present in the amount of 1–5% of the composition, is selected from the group consisting of nonionic surfactants, amphoteric surfactants, and their combinations. Preferably, the surfactant is present in the amount of 1%.

The nonionic surfactant, preferably, is comprised of one or a mixture of short chain, low molecular weight linear primary alcohol ethoxylates, random secondary alcohol ethoxylates, and polar compounds, such as amine oxides. The primary alcohols ethoxylates are represented by the general formula:

$$R-O-(CH_2-CH_2-O)_n-H$$

wherein R is an alkyl radical having from 9 to 16 carbon atoms and the number of ethoxylate groups, n, is from 1 to 7. Commercially available nonionic surfactants of this type are sold by Shell Chemical Company under the tradename Neodol and by Union Carbide Corporation under the tradename Tergitol.

The secondary alcohol ethoxylates are represented by the general formula:

$$CH_3-(CH_2)_x-\underset{\underset{(CH_2-CH_2-O)_n-H}{|}}{\overset{\overset{O}{|}}{CH}}-(CH_2)_y-CH_3$$

Wherein x=y is from 6 to 15 and the number of ethoxylate groups, n, is from 1 to 9. Commercially available surfactants of this type are sold by Union Carbide Corporation under the tradename Tergitol S series surfactants, with Tergitol 15-S-9(T 15-S-9) being preferred for use herein.

The useful amine oxides are represented by the general formula:

$$R_1-\overset{\overset{R_2}{|}}{\underset{\underset{R_3}{|}}{N}}-O$$

wherein $R_1$ is an alkyl radical containing from 12 to 18 carbon atoms, and $R_2$ and $R_3$ are methyl, ethyl or hydroxyethyl. Commercially available surfactants of this type are sold by Armak under the tradename Aromox surfactant, such as, for example, Aromox DMMC-W the tradename for dimethyl cocoamine oxide.

Other useful surfactant systems include: combinations of high EO-low EO alcohol ethoxylates and combinations of mono or dialkyl quaternary compounds and the nonionic surfactants mentioned above.

Preferable ethoxylate mixtures comprise $C_{12}$–$C_{15}$ alcohol ethoxylates having 9 to 12 ethoxy groups in combination with $C_{12}$–$C_{15}$ alcohol ethoxylates having 3 to 6 ethoxy groups.

The quaternary compounds suitable for use in combination with the above mentioned nonionics are represented by the general formula:

$$R_1-\overset{\overset{CH_3}{|}}{\underset{\underset{R_2}{|}}{N}}-CH_3X$$

wherein $R_1$ is $CH_3$ or an alkyl radical containing from 10 to 14 carbon atoms and $R_2$ is an alkyl radical containing from 10 to 14 carbon atoms and X is a halogen such as bromide or chloride. Preferably the quaternary compound used in combination with nonionic surfactant is tetradecyltrimethylammonium bromide.

The amphoteric surfactant is preferably comprised of water-soluble betaine surfactants having the following structure $$R_1-\overset{\overset{CH_3}{|}}{\underset{\underset{CH_3}{|}}{N}}-R_2-COO^-$$

wherein $R_1$ is an alkyl radical containing from 8 to 18 carbon atoms, or the amido radical:

$$R-\overset{\overset{O}{|}}{C}-\overset{\overset{H}{|}}{N}-(CH_2)_a-$$

wherein R is an alkyl group having about 8 to 18 carbon atoms and a is the integer 1 to 4; $R_2$ is an alkylene group having from 1 to 4 carbon atoms. Suitable betaines include dodecyl dimethyl betaine and cocoamidopropyl betaine.

The composition also contains from 2 to 8% of a builder salt or electrolyte, which is comprised of phosphates, such as tetrapotassium pyrophosphate, sodium tripolyphosphate; carbonates, such as sodium carbonate, sodium sesquicarbonate and sodium bicarbonate; silicates and metasilicates, such as sodium metasilicate; and mixtures thereof. The preferred amount of the builder in the composition is 2%.

About 1-5% of an alkanolamine is also present, which comprises monoethanolamine, diethanolamine or triethanolamine. About 2.0% of the alkanolamine in the composition is preferred.

The solvent comprises about 2-8% of the composition. The solvent is selected from the group consisting of $C_6$-$C_{13}$ alkyl acetates, such as hexyl acetate; and water soluble glycol ethers such as diethylene glycol monobutyl ether (Butyl Carbitol), ethylene glycol monobutyl ether, ethylene glycol methyl ether, and propylene glycol methyl ether.

Water completes the balance of the composition (from about 74-96%), the pH of which ranges from 9 to 13.

In order to easily prepare a soil to be applied to test surfaces when comparing the efficacy of different detergent compositions, a "model soil" having the properties of "polymerized grease" was developed. This eliminated the need to run a control each time a test was run. It comprised a partially polymerized corn oil (the most frequently used frying oil) pigment and solvent. The pigment is included to improve the resolution of reflectance data, and the solvent provides ease of application.

The "model soil" was applied to a substrate by using a mohair piece or a brush as a thin film and placed at room temperature for 1 to 3 days depending on the type of substrate and the tenacity of the soil required.

QUANTITATIVE EVALUATION OF SOIL REMOVAL

This involved mechanical scrubbing of the soiled panels using a Gardner Instrument equipped with two pads with mohair surfaces. The mohair surface was initially soaked in the cleaning solution. After soil removal was performed at the specified number of strokes, a quantitative estimate of the relative cleaning efficiency was determined photometrically.

The compositions of the present invention are particularly adapted to be utilized by being sprayed onto the soiled surface from a trigger spray package and thereafter wiped off. It has been found that a spray cleaner that shows superior performance in removing "polymerized grease" comprises:

| | | % |
|---|---|---|
| Water miscible solvent | Butyl Carbitol | 5 |
| Nonionic Surfactant | Ethoxylated alcohol (NEODOL 23-6.5) | 1 |
| Builder/Buffer | TKPP | 2 |
| Alkanolamine | TEA | 2 |
| pH | 12 | |

A comparison of the above composition with a commercially available spray cleaner indicates the use of the nonionic surfactant instead of the linear alkyl benzene sulfonate (LAS) anionic surfactant used in the commercial spray cleaner had a major effect in cleaning efficiency of the spray cleaner.

Results of the performance assessment of this formula (FORMULA B) on both the "polymerized grease" is illustrated in the following table.

TABLE I

| | Percent Soil Removal |
|---|---|
| Current prototype (Formula B) | 75 |
| Commercial All Purpose Cleaner | 10 |
| Commercial Spray Cleaner (a) | 40 |
| Commercial Spray Cleaner (b) | 60 |
| Soil: Polymerized Corn Oil | |
| Substrate: Latex Painted Wallboard | |
| Conditions: Gardner Test 10 Strokes | |

A series of surfactants, solvents and builders were screened in an attempt to optimize the performance of the formulations of this invention against the model greasy soil "polymerized grease". The composition of this formulation was:

BUILDER/SURFACTANT/SOLVENT-/TEA:2/1/4/2

Table II shows the results from the evaluation of a series of surfactants. All surfactants were used at 1% level. The concentrations of the builder (TKPP at 2%) and the solvent (Butyl Carbitol at 4%) were kept constant in all cases.

TABLE II

| Type of Surfactant | Percent Soil Removal |
|---|---|
| Na paraffin sulfonate | 20 |
| Na $C_{12}$ alkylbenzene sulfonate | 40 |
| Tergitol 15-S-9 | 80 |
| Alfonic 610-50 | 82 |
| Neodol 23-6.5 | 83 |
| Tego Betaine BL-158 | 82 |
| Barlox-14 | 85 |
| No Surfactant | 20 |

As shown in Table II, nonionic and amphoteric surfactants perform significantly better than the anionics.

Table III shows the result of the evaluation of a series of solvents including glycol ethers and alkyl acetates. All solvents were used at a 4% level. The concentrations of the surfactant (Neodol 23-6.5 at 1%) and builder (TKPP at 2%) were kept constant in all cases. Exxate 600 and 700 are mixed isomers of hexyl and heptyl acetates respectively (manufactured by Exxon).

TABLE III

| Solvent | Percent Soil Removal |
|---|---|
| Butyl Cellosolve | 78 |
| Butyl Carbitol | 78 |
| Exxate 700 | 80 |
| Ethyl Acetate | 82 |
| Exxate 600 | 85 |
| No Solvent | 70 |

Results in removing polymerized grease are shown in Table I. It can be seen that the prototype formula resulted in 75% soil removal which was significantly better than the market leader among the spray cleaner products. The prototype formula also outperformed another commercially available spray cleaner.

Liquid all purpose cleaners (APCs), which do not contain solvent, are generally poor in removing polymerized grease, as will be noted by the results for product Nos. 3-5.

The result of the evaluation of four builder salts useful in the present invention is shown in Table IV in comparison to caustic-containing and builder-free formulas.

TABLE IV

| Builder/Buffer | Percent Soil Removal |
|---|---|
| NaOH | 72 |
| Na Silicate | 70 |
| TKPP | 70 |
| Na Carbonate | 72 |
| NaH EDTA | 70 |
| No Builder | 30 |

As will be noted, although the presence of builder makes significant impact on performance among different builders, no significant difference in performance is observed.

The detergent compositions of the present invention, as well as their efficacy, will not be illustrated by the following examples, wherein all parts and percentages are by weight and all temperatures in degrees Celsius unless otherwise indicated.

TABLE V

| | Examples | | | | | | | Commercial Spray | Commercial Lemon |
|---|---|---|---|---|---|---|---|---|---|
| Ingredient | #1 | #2 | #3 | #4 | #5 | #6 | #7 | Clnr | APC |
| Tergitol 15-S-9 | 1.0 | | | | | 1.0 | 1.0 | | |
| Neodol 23-6.5 | | 1.0 | | | | | | | |
| Alfonic 610-50 | | | 1.0 | | | | | | |
| Amine Oxide (Barlox-14) | | | | 1.0 | | | | | |
| Betaine BL-158 | | | | | 1.0 | | | | |
| Butyl Carbitol | 5.0 | 5.0 | 5.0 | 5.0 | 5.0 | 5.0 | | | |
| Exxate 600 | | | | | | | 5.0 | | |
| TKPP | 2.0 | 2.0 | 2.0 | 2.0 | 2.0 | | 2.0 | | |
| Sodium Carbonate | | | | | | 2.0 | | | |
| TEA | 2.0 | 2.0 | 2.0 | 2.0 | 2.0 | 2.0 | 2.0 | | |
| NaOH (adjust to pH = 12) | | | | | | | | | |
| Water (Balance) | | | | | | | | | |
| Soil Removal (polymerized grease on wall board) Gardner: 10 strokes 12.6 g/cm$^2$ soil load | 81 | 82 | 82 | 88 | 82 | 77 | 87 | 49 | 32 |

As previously indicated, the compositions of the present invention are preferably formulated as clear, single phase liquids. However, it is within the ambit of this invention to formulate these compositions as gels and aerosols, and they may be dispensed from both pump sprayers and aerosol cans. Preparation of compositions suitable to be dispensed by aerosol or pump spray is within the ordinary skill in the art.

When it is desired to use a thickening agent with the compositions of the invention, for example when the organic matter to be removed is on a non-horizontal surface and it is desirable to maintain contact between these compositions and the soiled surface, any such agent, or mixture of two or more thereof, which is compatible with the ingredients of these formulations may be used. Useful organic thickening agents include starch, sodium carboxymethylcellulose, hydroxyethyl cellulose, methocel, and water-soluble polymers such as carboxy vinyl polymer (Carbopols—B. F. Goodrich Chemical Company), sodium polyacrylate, polyacrylic acid, gums including Xanthan gums such as Keltrol-,—Kelco Company. Inorganic colloidal materials [clays] including Veegum (magnesium aluminum silicate—R. T. Vanderbilt), are also effective. When used, the thickening agent will typically vary between 0.1 to 6% by weight of the composition. Generally, it is desired to maintain the viscosity of these formulations between 100 and 150 cps. If the viscosity is too low, the compositions do not adhere well to the soiled surfaces. If too high, it has been found that the efficacy of these compositions is diminished.

Suitable foam boosters and foam stabilizers include cocomonoethanolamide, lauryl diethanolamide, lauryl/myristyl monoethanolamide, cocobetaine, and lauryl/myristyl diethanolamide.

What is claimed is:

1. A single phase liquid detergent composition especially effective in removing greasy soils from hard surfaces consisting essentially of a mixture of:

a. from about 1 to 5% of at least one surfactant selected from the group consisting of nonionic, polar nonionic, and amphoteric surfactants or mixtures thereof;

b. about 1–6% of a builder;

c. from about 1–5% of an alkanolamine selected from the group consisting of monoethanolamine, diethanolamine, and triethanolamine;

d. from about 2 to 8% of at least one organic solvent, said solvent selected from the group consisting of water soluble glycol ethers and alkyl acetates; and e. water, wherein the pH of the composition ranges from 9 to 13.

2. The detergent of claim 1 wherein the nonionic surfactant is selected from the group consisting of alcohol ethoxylates and amine oxides.

3. The detergent of claim 2 wherein the alcohol ethoxylate is selected from the group consisting of linear primary alcohol ethoxylates, random secondary alcohol ethoxylates.

4. The detergent of claim 3 wherein the surfactant is selected from the group consisting of combinations of high EO—low EO alcohol ethoxylates and combinations of mono or di alkylquaternary compounds.

5. The detergent of claim 1 wherein the amphoteric surfactant is selected from the group consisting of water-soluble betaines.

6. The detergent of claim 5 wherein the betaine surfactant is dodecyl dimethylammonium acetate.

7. The detergent of claim 1 wherein the builder is selected from the group consisting of tetrapotassium pyrophosphate (TKPP), sodium tripolyphosphate (STPP), sodium metasilicate, sodium carbonate, sodium bicarbonate, and mixtures thereof.

8. The detergent of claim 1 wherein the water soluble glycol ether solvent is selected from the group consisting of diethylene glycol monobutyl ether, ethylene glycol monobutyl ether, ethylene glycol methyl ether, and propylene glycol methyl ether.

* * * * *